US012338031B2

(12) United States Patent
Wood

(10) Patent No.: US 12,338,031 B2
(45) Date of Patent: Jun. 24, 2025

(54) STACKABLE CUP

(71) Applicant: Landon S. Wood, San Antonio, TX (US)

(72) Inventor: Landon S. Wood, San Antonio, TX (US)

( * ) Notice: Subject to any disclaimer, the term of this patent is extended or adjusted under 35 U.S.C. 154(b) by 0 days.

(21) Appl. No.: 18/032,520

(22) PCT Filed: Oct. 22, 2021

(86) PCT No.: PCT/US2021/056357
§ 371 (c)(1),
(2) Date: Apr. 18, 2023

(87) PCT Pub. No.: WO2022/087490
PCT Pub. Date: Apr. 28, 2022

(65) Prior Publication Data

US 2023/0415958 A1 Dec. 28, 2023

Related U.S. Application Data

(60) Provisional application No. 63/104,836, filed on Oct. 23, 2020.

(51) Int. Cl.
*B65D 21/02* (2006.01)
*B65D 23/10* (2006.01)
(Continued)

(52) U.S. Cl.
CPC ..... *B65D 21/0231* (2013.01); *B65D 23/10* (2013.01); *B65D 43/0231* (2013.01);
(Continued)

(58) Field of Classification Search
CPC ..... A47G 19/2266; A47G 19/23; A47G 23/0208; B65D 1/00; B65D 1/02;
(Continued)

(56) References Cited

U.S. PATENT DOCUMENTS 4,443,896 A 4/1984 Porat et al.
4,485,923 A 12/1984 Schwaikert
(Continued)

FOREIGN PATENT DOCUMENTS

FR 2335416 A1 7/1977
FR 2970951 A1 * 8/2012 ..... B65D 21/02
(Continued)

OTHER PUBLICATIONS

Ebay, 77 VTG Retro Tupperware Harvest Stacking Mugs with Coasters/Lids 4 lids, https://www.ebay.com/itm/7-VTG-RETRO-TUPPERWARE-HARVEST-STACKING-MUGS.
(Continued)

*Primary Examiner* — Anthony D Stashick
*Assistant Examiner* — Marcos Javier Rodriguez Molina
(74) *Attorney, Agent, or Firm* — Jacob M. Ward; Ward Law Office LLC

(57) ABSTRACT

A sippy cup stacking system comprising multiple substantially identical sippy cups having sippy spout lids that can be mated with the bottom of a first cup while attached to the top of a second cup. Each cup includes a bottom with an annular recess containing a central locking plug capable of mating with a central locking stem protruding from a lid on another cup. The sippy spout on each lid is radially offset from the locking stem and fits into and can move circumferentially in the annular recess on the bottom of the cup to which it is being mated, until the spout is fully enclosed by the bottom of the mated cup.

16 Claims, 8 Drawing Sheets

(51) Int. Cl.

| | |
|---|---|
| ***B65D 43/02*** | (2006.01) |
| ***B65D 47/06*** | (2006.01) |
| *A47G 19/22* | (2006.01) |
| *A47G 19/23* | (2006.01) |
| *B65D 1/10* | (2006.01) |
| *B65D 1/26* | (2006.01) |

(52) U.S. Cl.
CPC .... *B65D 47/06* (2013.01); *B65D 2543/00046* (2013.01); *B65D 2543/00092* (2013.01); *B65D 2543/00537* (2013.01)

(58) Field of Classification Search
CPC .. B65D 1/0207; B65D 1/0215; B65D 1/0223; B65D 1/023; B65D 1/0238; B65D 1/0246; B65D 1/0261; B65D 1/0276; B65D 1/0284; B65D 1/0292; B65D 1/04; B65D 1/06; B65D 1/095; B65D 1/10; B65D 1/12; B65D 1/14; B65D 1/16; B65D 1/165; B65D 1/18; B65D 1/20; B65D 1/22; B65D 1/225; B65D 1/24; B65D 1/243; B65D 1/26; B65D 1/265; B65D 1/30; B65D 1/32; B65D 1/323; B65D 1/34; B65D 1/36; B65D 1/38; B65D 1/40; B65D 1/42; B65D 1/44; B65D 1/46; B65D 1/48; B65D 11/00; B65D 11/02; B65D 11/04; B65D 11/06; B65D 11/08; B65D 11/10; B65D 11/18; B65D 11/1833; B65D 11/184; B65D 11/1846; B65D 11/186; B65D 11/1866; B65D 11/1873; B65D 11/1893; B65D 11/20; B65D 11/22; B65D 11/24; B65D 11/26; B65D 15/00; B65D 15/04; B65D 15/06; B65D 15/08; B65D 15/18; B65D 15/22; B65D 15/24; B65D 17/00; B65D 17/28; B65D 17/40; B65D 17/401; B65D 17/4011; B65D 17/4012; B65D 17/4014; B65D 17/404; B65D 17/462; B65D 17/50; B65D 17/501; B65D 17/502; B65D 17/506; B65D 19/0028; B65D 19/0075; B65D 19/0095; B65D 19/02; B65D 19/06; B65D 19/10; B65D 19/12; B65D 19/18; B65D 19/20; B65D 19/40; B65D 21/00; B65D 21/02; B65D 21/0201; B65D 21/0202; B65D 21/0204; B65D 21/0206; B65D 21/0209; B65D 21/0211; B65D 21/0212; B65D 21/0213; B65D 21/0215; B65D 21/0217; B65D 21/0219; B65D 21/022; B65D 21/0222; B65D 21/0223; B65D 21/0224; B65D 21/0226; B65D 21/0227; B65D 21/0228; B65D 21/023; B65D 21/0231; B65D 21/0233; B65D 21/0234; B65D 21/0235; B65D 21/0237; B65D 21/0238; B65D 21/04; B65D 21/043; B65D 21/045; B65D 21/046; B65D 21/06; B65D 21/062; B65D 21/064; B65D 21/066; B65D 21/08; B65D 21/083; B65D 21/086; B65D 2203/00; B65D 2203/02; B65D 2203/04; B65D 2203/06; B65D 2203/10; B65D 2203/12; B65D 2205/00; B65D 2205/02; B65D 2207/00; B65D 2209/00; B65D 2213/00; B65D 2213/02; B65D 2215/00; B65D 2215/02; B65D 2215/04; B65D 2215/06; B65D 2221/00; B65D 2231/005; B65D 2231/008; B65D 2231/02; B65D 2231/022; B65D 2231/025; B65D 2251/0009; B65D 2251/0015; B65D 2251/0018; B65D 2251/0021; B65D 2251/0025; B65D 2251/0028; B65D 2251/0031; B65D 2251/005; B65D 2251/0056; B65D 2251/0062; B65D 2251/0068; B65D 2251/0071; B65D 2251/0075; B65D 2251/0078; B65D 2251/0081; B65D 2251/0087; B65D 2251/009; B65D 2251/0093; B65D 2251/01; B65D 2251/02; B65D 2251/023; B65D 2251/04; B65D 2251/06; B65D 2251/065; B65D 2251/09; B65D 2251/10; B65D 2251/1008; B65D 2251/1016; B65D 2251/1025; B65D 2251/1033; B65D 2251/1041; B65D 2251/105; B65D 2251/1058; B65D 2251/1066; B65D 2251/1083; B65D 2251/1091; B65D 2251/20; B65D 2251/205; B65D 2255/20; B65D 23/00; B65D 23/001; B65D 23/02; B65D 23/06; B65D 23/0842; B65D 23/0871; B65D 23/0878; B65D 23/0885; B65D 23/10; B65D 23/102; B65D 23/104; B65D 23/106; B65D 23/108; B65D 23/12; B65D 2313/00; B65D 2313/02; B65D 2313/04; B65D 2401/00; B65D 2401/05; B65D 2401/10; B65D 2401/15; B65D 2401/20; B65D 2519/0096; B65D 2519/00965; B65D 2519/00975; B65D 2519/0099; B65D 2519/00995; B65D 2525/281; B65D 2525/283; B65D 2525/285; B65D 2525/287; B65D 2525/289; B65D 2539/003; B65D 2543/00009; B65D 2543/00027; B65D 2543/00037; B65D 2543/00046; B65D 2543/00055; B65D 2543/00074; B65D 2543/00083; B65D 2543/00092; B65D 2543/00101; B65D 2543/0012; B65D 2543/00138; B65D 2543/00148; B65D 2543/00166; B65D 2543/00175; B65D 2543/00194; B65D 2543/00203; B65D 2543/00212; B65D 2543/00222; B65D 2543/00231; B65D 2543/0024; B65D 2543/0025; B65D 2543/00268; B65D 2543/00277; B65D 2543/00296; B65D 2543/00305; B65D 2543/00314; B65D 2543/00324; B65D 2543/00333; B65D 2543/00342; B65D 2543/00351; B65D 2543/00361; B65D 2543/0037; B65D 2543/00379; B65D 2543/00388; B65D 2543/00398; B65D 2543/00407; B65D 2543/00416; B65D 2543/00425; B65D 2543/00435; B65D 2543/00453; B65D 2543/00462; B65D 2543/00472; B65D 2543/00481; B65D 2543/0049; B65D 2543/005; B65D 2543/00509; B65D 2543/00518; B65D 2543/00527; B65D 2543/00537; B65D 2543/00546; B65D 2543/00555; B65D 2543/00564; B65D 2543/00574; B65D 2543/00583; B65D 2543/00592; B65D 2543/00601; B65D 2543/00611; B65D 2543/0062; B65D 2543/00629; B65D 2543/00638; B65D 2543/00648; B65D 2543/00657; B65D 2543/00666; B65D 2543/00685; B65D 2543/00694; B65D 2543/00703; B65D 2543/00712; B65D 2543/00731; B65D 2543/0074; B65D 2543/0075; B65D 2543/00759; B65D 2543/00768; B65D 2543/00787; B65D 2543/00796; B65D 2543/00805; B65D 2543/00814; B65D 2543/00824; B65D 2543/00833; B65D 2543/00842; B65D 2543/00851; B65D 2543/0087; B65D 2543/00879; B65D 2543/00888; B65D 2543/00898; B65D 2543/00907; B65D 2543/00925; B65D 2543/00935; B65D 2543/00944; B65D 2543/00953; B65D 2543/00962; B65D 2543/00972; B65D 2543/00981; B65D 2543/0099; B65D 2547/063; B65D 2565/385; B65D 2565/386; B65D 2571/0003; B65D 2571/00037; B65D 2571/00055; B65D 2571/00086; B65D 2571/00111; B65D 2575/3245; B65D 2575/3281; B65D 2575/565; B65D 2575/586; B65D 2577/042; B65D 2577/043; B65D 2577/047; B65D 2577/2008; B65D 2577/205; B65D 2577/2083; B65D 2577/2091; B65D 2581/3406; B65D 2581/3408; B65D 2581/341; B65D 2581/3425; B65D 2581/3428; B65D 2581/3431; B65D 2581/3433; B65D 2581/3439; B65D 2581/344; B65D 2581/3472; B65D 2581/3477; B65D 2581/3479; B65D 2581/349; B65D 2581/3491; B65D 2581/3493; B65D 2581/3498; B65D 2583/0413; B65D 2583/0431; B65D 2583/0481; B65D 2583/082; B65D 2585/00; B65D 2585/366; B65D 2585/545; B65D 2585/6882; B65D 2585/86; B65D 2590/005; B65D 2590/0066; B65D 2590/046; B65D 3/04; B65D 3/06; B65D 3/12; B65D 3/24; B65D 3/266; B65D 3/30; B65D 31/06; B65D 31/10; B65D 33/00; B65D 33/001; B65D 33/02; B65D 33/14; B65D 33/16; B65D 33/1658; B65D 33/25; B65D 33/2508; B65D 33/2541; B65D 33/255; B65D 33/2558; B65D 35/00; B65D 35/10; B65D 35/12; B65D 35/22; B65D 35/28; B65D 37/00; B65D 39/00; B65D 39/04; B65D 39/08; B65D 41/02; B65D 41/04; B65D 41/045; B65D 41/0457; B65D 41/0492; B65D 41/06; B65D 41/16; B65D 41/28; B65D 41/32; B65D 41/3447; B65D 41/3457; B65D 41/48; B65D 41/485; B65D 43/00; B65D 43/02; B65D 43/0208; B65D 43/021; B65D 43/0216; B65D 43/0218; B65D 43/022; B65D 43/0227; B65D 43/0229; B65D 43/0237; B65D 43/0239; B65D 43/0243; B65D 43/0252; B65D 43/0254; B65D 43/026; B65D 43/0262; B65D 43/0268; B65D 43/06; B65D 43/08; B65D 43/161; B65D 43/162; B65D 43/166; B65D 43/168; B65D 43/22; B65D 43/24; B65D 45/16; B65D 45/18; B65D 45/30; B65D 45/32; B65D 47/043; B65D 47/046; B65D 47/065; B65D 47/0804; B65D 47/0823; B65D 47/0828; B65D 47/0833; B65D 47/0847; B65D 47/0852; B65D 47/0876; B65D 47/088; B65D 47/089; B65D 47/103; B65D 47/106; B65D 47/127; B65D 47/128; B65D 47/185; B65D 47/20; B65D 47/2031; B65D 47/241; B65D 47/242; B65D 47/246; B65D 47/247; B65D 47/265; B65D 47/283; B65D 47/32; B65D 47/36; B65D 49/08; B65D 5/002; B65D 5/209; B65D 5/22; B65D 5/241; B65D 5/3607; B65D 5/3614; B65D 5/3635; B65D 5/3678; B65D 5/3692; B65D 5/38; B65D 5/4241; B65D 5/4275; B65D 5/4295; B65D 5/46008; B65D 5/4608; B65D 5/46096; B65D 5/48046; B65D 5/5011; B65D 5/5445; B65D 5/563; B65D 5/6647; B65D 5/6664; B65D 5/724; B65D 5/725; B65D 50/00; B65D 50/04; B65D 51/002; B65D 51/007; B65D 51/16; B65D 51/1605; B65D 51/1644; B65D 51/165; B65D 51/1661; B65D 51/1666; B65D 51/1677; B65D 51/1683; B65D 51/1688; B65D 51/1694; B65D 51/18; B65D 51/185; B65D 51/20; B65D 51/22; B65D 51/226; B65D 51/228; B65D 51/24; B65D 51/241; B65D 51/242; B65D 51/243; B65D 51/245; B65D 51/246; B65D 51/247; B65D 51/248; B65D 51/249; B65D 51/26; B65D 51/28; B65D 51/2807; B65D 51/2821; B65D 51/2828; B65D 51/2835; B65D 51/2871; B65D 51/30; B65D 51/32; B65D 53/00; B65D 53/02; B65D 53/04; B65D 55/00; B65D 55/02; B65D 55/022; B65D 55/024; B65D 55/026; B65D 55/028; B65D 55/06; B65D 55/0818; B65D 55/0854; B65D 55/0881; B65D 55/12; B65D 55/14; B65D 55/16; B65D 55/165; B65D 57/003; B65D 59/04; B65D 61/00; B65D 61/02; B65D 63/109; B65D 65/40; B65D 65/46; B65D 65/466; B65D 67/02; B65D 69/00; B65D 7/00; B65D 7/04; B65D 7/045; B65D 7/20; B65D 7/24; B65D 7/26; B65D 7/30; B65D 71/0077; B65D 71/0096; B65D 71/02; B65D 71/063; B65D 71/08; B65D 71/12; B65D 71/44; B65D 71/48; B65D 71/50; B65D 71/502; B65D 71/507; B65D 71/70; B65D 73/0014; B65D 73/0035; B65D 73/0042; B65D 75/002; B65D 75/008; B65D 75/02; B65D 75/22; B65D 75/225; B65D 75/24; B65D 75/245; B65D 75/26; B65D 75/28; B65D 75/30; B65D 75/32; B65D 75/323; B65D 75/326; B65D 75/327; B65D 75/328; B65D 76/36; B65D 75/42; B65D 75/525; B65D 75/527; B65D 75/54; B65D 75/56; B65D 75/563; B65D 75/566; B65D 75/58; B65D 75/5805; B65D 75/5811; B65D 75/5827; B65D 75/5838; B65D 75/5855; B65D 75/5861; B65D 75/5866; B65D 75/5872; B65D 75/5877; B65D 75/5883; B65D 75/5888;

B65D 75/5894; B65D 77/003; B65D 77/02; B65D 77/04; B65D 77/0406; B65D 77/0413; B65D 77/042; B65D 77/0426; B65D 77/0433; B65D 77/0446; B65D 77/0453; B65D 77/046; B65D 77/0466; B65D 77/048; B65D 77/0486; B65D 77/0493; B65D 77/06; B65D 77/061; B65D 77/062; B65D 7/065; B65D 77/067; B65D 77/068; B65D 77/10; B65D 77/20; B65D 77/2016; B65D 77/2024; B65D 77/2032; B65D 77/2052; B65D 77/208; B65D 77/2088; B65D 77/2092; B65D 77/22; B65D 77/225; B65D 77/24; B65D 77/245; B65D 77/28; B65D 77/30; B65D 79/00; B65D 79/0081; B65D 79/0084; B65D 79/0087; B65D 79/02; B65D 81/02; B65D 81/022; B65D 81/025; B65D 81/03; B65D 81/05; B65D 81/052; B65D 81/127; B65D 81/18; B65D 81/20; B65D 81/2015; B65D 81/2038; B65D 81/2076; B65D 81/22; B65D 81/24; B65D 81/261; B65D 81/262; B65D 81/263; B65D 81/265; B65D 81/266; B65D 81/267; B65D 81/268; B65D 81/28; B65D 81/32; B65D 81/3205; B65D 81/3211; B65D 81/3216; B65D 81/3222; B65D 81/3227; B65D 81/3233; B65D 81/3238; B65D 81/3244; B65D 81/3261; B65D 81/3288; B65D 81/3294; B65D 81/34; B65D 81/343; B65D 81/3438; B65D 81/3453; B65D 81/3484; B65D 81/36; B65D 81/361; B65D 81/363; B65D 81/365; B65D 81/3806; B65D 81/3811; B65D 81/3813; B65D 81/3816; B65D 81/3818; B65D 81/3823; B65D 81/3832; B65D 81/3834; B65D 81/3837; B65D 81/3841; B65D 81/3862; B65D 81/3865; B65D 81/3867; B65D 81/3869; B65D 81/3876; B65D 81/3879; B65D 81/3881; B65D 81/3886; B65D 81/3888; B65D 83/00; B65D 83/005; B65D 83/0027; B65D 83/0038; B65D 83/0055; B65D 83/0061; B65D 83/0072; B65D 83/0083; B65D 83/0094; B65D 83/02; B65D 83/04; B65D 83/0409; B65D 83/0418; B65D 83/0427; B65D 83/0454; B65D 83/0463; B65D 83/0481; B65D 83/06; B65D 83/08; B65D 83/0805; B65D 83/0811; B65D 83/0817; B65D 83/0823; B65D 83/0829; B65D 83/0841; B65D 83/0847; B65D 83/087; B65D 83/0876; B65D 83/0894; B65D 83/14; B65D 83/16; B65D 83/20; B65D 83/201; B65D 83/205; B65D 83/206; B65D 83/22; B65D 83/226; B65D 83/228; B65D 83/262; B65D 83/28; B65D 83/285; B65D 83/30; B65D 83/303; B65D 83/306; B65D 83/36; B65D 83/38; B65D 83/384; B65D 83/386; B65D 83/40; B65D 83/42; B65D 83/425; B65D 83/44; B65D 83/46; B65D 83/48; B65D 83/52; B65D 83/54; B65D 83/60; B65D 83/62; B65D 83/64; B65D 83/66; B65D 83/663; B65D 83/682; B65D 83/75; B65D 83/753; B65D 83/7535; B65D 85/00; B65D 85/04; B65D 85/08; B65D 85/10; B65D 85/12; B65D 85/18; B65D 85/187; B65D 85/20; B65D 85/26; B65D 85/30; B65D 85/305; B65D 85/32; B65D 85/324; B65D 85/34; B65D 85/36; B65D 85/42; B65D 85/48; B65D 85/50; B65D 85/544; B65D 85/58; B65D 85/60; B65D 85/62; B65D 85/671; B65D 85/672; B65D 85/676; B65D 85/70; B65D 85/72; B65D 85/73; B65D 85/78; B65D 85/80; B65D 85/804; B65D 85/8043; B65D 85/8049; B65D 85/8052; B65D 85/8055; B65D 85/8061; B65D 85/8064; B65D 85/816; B65D 85/84; B65D 88/02; B65D 88/027; B65D 88/12; B65D 88/121; B65D 88/14; B65D 88/522; B65D 88/526; B65D 88/528; B65D 88/54; B65D 88/745; B65D 9/06; B65D 90/00; B65D 90/0033; B65D 90/0046; B65D 90/0053; B65D 90/006; B65D 90/0066; B65D 90/0073; B65D 90/008; B65D 90/0086; B65D 90/046; B65D 90/06; B65D 90/08; B65D 90/105; B65D 90/12; B65D 90/20; B65D 90/22; B65D 90/24; B65D 90/48

USPC ..... 206/0.5, 0.7, 1.5, 1.7, 141, 144, 15.2, 206/15.3, 158, 159, 160, 162, 201, 203, 206/204, 205, 209.1, 215, 216, 217, 218, 206/219, 220, 221, 222, 223, 225, 226, 206/228, 229, 232, 233, 236, 256, 260, 206/265, 268, 269, 270, 278, 292, 303, 206/307, 307.1, 308.1, 308.2, 309, 310, 206/311, 312, 313, 315.11, 315.9, 361, 206/362, 362.1, 363, 364, 365, 366, 369, 206/370, 373, 386, 387.13, 388, 389, 394, 206/403, 407, 409, 425, 427, 430, 438, 206/443, 449, 45.25, 454, 455, 456, 457, 206/459.1, 459.5, 460, 461, 462, 464, 206/466, 467, 469, 470, 471, 472, 473, 206/477, 480, 483, 486, 487, 488, 493, 206/494, 497, 499, 5.1, 501, 503, 504, 206/505, 506, 507, 508, 509, 510, 511, 206/514, 515, 516, 517, 518, 519, 520, 206/521, 521.1, 521.8, 524.2, 524.8, 525, 206/526, 527, 528, 531, 532, 534, 534.2, 206/535, 538, 539, 540, 541, 545, 546, 206/549, 551, 553, 557, 558, 560, 561, 206/562, 564, 565, 569, 570, 571, 579, 206/581, 586, 591, 593, 594, 599, 6.1, 206/600, 63.3, 63.5, 707, 710, 711, 722, 206/736, 749, 752, 784, 803, 804, 806, 206/807, 812, 814, 815, 818, 820, 823, 206/831, 832

See application file for complete search history.

(56) References Cited

U.S. PATENT DOCUMENTS

| | | | | |
|---|---|---|---|---|
| 5,312,011 | A | 5/1994 | Fischer | |
| 5,409,128 | A | 4/1995 | Mitchell | |
| 5,692,617 | A | 12/1997 | Adams | |
| 6,076,699 | A * | 6/2000 | Seager | B65D 43/021 215/396 |
| 6,886,694 | B2 | 5/2005 | McNeeley et al. | |
| 8,157,122 | B2 | 4/2012 | Dale | |

(56) References Cited

U.S. PATENT DOCUMENTS

| | | | | |
|---|---|---|---|---|
| 8,844,758 | B1 * | 9/2014 | Kummer | B65D 43/0231 206/508 |
| 8,919,603 | B2 * | 12/2014 | Greene | A47G 23/0216 215/396 |
| 2002/0185495 | A1 * | 12/2002 | Manganiello | B65D 47/2031 220/717 |
| 2003/0136699 | A1 * | 7/2003 | McNeeley | B65D 21/0222 206/518 |
| 2005/0056614 | A1 * | 3/2005 | Morano | A47G 19/2272 215/396 |
| 2006/0255000 | A1 * | 11/2006 | Quintana | B65D 21/0231 215/10 |
| 2009/0127152 | A1 * | 5/2009 | Bou-Mezrag | B65D 21/0231 206/509 |
| 2013/0233855 | A1 | 9/2013 | DeSiena | |
| 2016/0368661 | A1 * | 12/2016 | Moore | B65D 47/089 |

FOREIGN PATENT DOCUMENTS

| | | | | |
|---|---|---|---|---|
| GB | 400766 A | | 11/1933 | |
| GB | 2182304 A | * | 5/1987 | B65D 1/30 |
| WO | 9515891 | | 6/1995 | |
| WO | 2009024004 | | 2/2009 | |
| WO | WO-2009024004 A1 | * | 2/2009 | B65D 21/0204 |

OTHER PUBLICATIONS

Amazon, The First Years Take & Toss Spill-Proof Sippy Cups, 10 Ounce, 4 Count, https://www.amazon.com/First-Years-Spill-Proof-Sippy-Ounce/dp/B000096M59.

Ecobio, Stackable PLA shaker lid, https://www.ecobioshopping.it/GB/pla-transparent-cups/861-stackable-pla-shaker-lid.html.

Kangcare, Re-Play 7-piece Snack Stack Made From Recycled Milk Jugs, https://kangacare.com/Buy-Replay-Snack-Stock-7.html.

Ebay, Tommee Tippee Essentials Stackable Food Pots and Lids BPA Free, https://www.ebay.co.uk/itm/Tommee-Tippee-Essentials-Stackable-Food-Pots-and-Lids-BPA.

Replay, Pack Your Snack, Replay-Snack Stack-info.

* cited by examiner

STACKABLE CUP

RELATED APPLICATIONS/PRIORITY BENEFIT CLAIM

This application claims priority to provisional patent application Ser. No. 63/104,836 filed Oct. 23, 2020 and entitled STACKABLE SIPPY CUP.

FIELD

The subject matter of the present application is in the field of stackable cups, such as "sippy" type cups with a sipping spout on a closure lid.

BACKGROUND

Sippy cups with removable lids having raised spouts are most commonly used for teaching children to transition their drinking from a bottle to a regular cup. Sippy-type cups with more sophisticated spouts, for example having manually-operated closures, may also be used by adults while engaged in biking, driving, and other mobile activities where drinking from an open cup would be difficult.

Storage of multiple sippy cups with lids in a compact space is desirable, especially for children's sippy cups where multiple clean and dirty cups can accumulate over the course of a day while a parent and child are out of the home running errands, traveling, etc., often with limited storage space such as in a stroller, diaper bag, or backpack.

Stackable containers and cups are known. U.S. Pat. No. 5,312,011 to Fischer shows a stackable container system where each container is snapped onto and securely fastened to another similarly configured container.

U.S. Pat. No. 5,409,128 to Mitchell shows stackable containers with bases having downwardly depending rims engaging a stepped lid of a container underneath with mating thread segments to lock them together.

U.S. Pat. No. 6,886,694 to McNeeley et al shows a nestable and stackable food container with a nesting structure provided at least in part on a portion of the base and at least in part on a portion of the lid. The nesting structure permits removably nesting the lower side of the base with the lid in either a standard lid orientation or an inverted orientation.

U.S. Pat. No. 8,157,122 to Dale shows a lidded container in which the container bottom is provided with a recess fitting over the protruding lid of a similar container when stacked.

U.S. Patent App. Pub. No. US 2013/0233855 A1 to DeSiena shows a sealable container for food or beverages with a lid having a raised panel that snappingly and releasably fits into the outside volume at the bottom of the container so that the lid snaps onto the container bottom for stacking.

International Pub. No. WO 95/15891 to Nytro (Dynoplast AS) shows a stackable cup for spoon foods, where the bases stack inside other cups with room for a spoon.

Commercially available products include the Tomrnee Tippee® Essentials Stackable Food Pots and Lids with recesses in the lids for receiving the bases of other cups above for stacking; the RePlay™ SnackStack™ lidded stackable containers; the EcoBio™ stackable shaker lid cups; TupperWare® Retro Harvest stacking mugs with lids; and, the First Years™ stackable sippy cups in which the cups are stacked with one another in a nested configuration and the lids are stacked on the uppermost cup lid in the cup stack.

To date there does not appear to be a convenient, clean, practical, and durable sippy cup stacking system where each sippy cup in the stack can have its own lid securely attached while stacked.

BRIEF SUMMARY

The present invention is a cup stacking system in which each of multiple substantially identical cups may be stacked with their lids secured to their respective cups. In one embodiment, the cups are sippy cups whose lids include protruding spouts. This provides the most convenient possible storage for both clean cups and dirty cups and is especially useful for children's sippy cups where a parent may want to go out of the house for the day with a number of pre-filled cups.

In a general form, the cup stacking system comprises a cup having a sidewall, an open top with a removable lid or removeable sippy spout lid, and a bottom. The bottom includes an annular recess defined between a lower sidewall and a locking plug protruding downwardly from the center of the bottom of the cup within the area bounded by the lower sidewall. The locking plug comprises a socket aligned with a longitudinal center axis of the cup. The sippy spout lid comprises a mating locking stem centered on and protruding from the upper side of the lid, also aligned with the longitudinal center axis of the cup, and further comprises a sippy spout protruding from the upper side of the lid higher than the locking stem and radially offset outwardly from the locking stem so that the spout is radially aligned with the annular recess in the bottom of the cup.

The locking stem on the lid of a first cup can be mated with the socket in the central locking plug on the bottom of a second cup in a removable locking connection, with the sippy spout on the first cup lid able to be circumferentially located anywhere relative to the bottom of the cup and to move circumferentially within the annular recess on the bottom of the second cup as the stem and socket are mated, until the two cups are tightly mated in a secure stack. Any number of lidded cups can be mated to stack in this manner. In a preferred form, the locking stem and locking plug are matingly threaded or otherwise configured to mate with a rotating fit, for example with threaded, twist-lock, or "bayonet" type connections or other rotational connections between the locking stem and plug.

The upper ends of the locking stem and the sippy spout on the first cup lid may abut in sealing or non-sealing fashion with the bottom of the second cup in the annular recess when the first and second cups are fully locked together.

The stem and the sippy spout may include relief valves, individually or in a connected assembly, that help prevent leaks and that assist with drinking.

In a further form, the central locking plug protruding from the bottom of the cup narrows downwardly so that the annular recess around the locking plug is tapered at its inner diameter. The inner side of the sippy spout is correspondingly angled for complementary rotating clearance in the annular recess.

These and other features and of the invention will become apparent from the detailed description below, in light, of the accompanying drawings.

DETAILED DESCRIPTION

Figure 1:
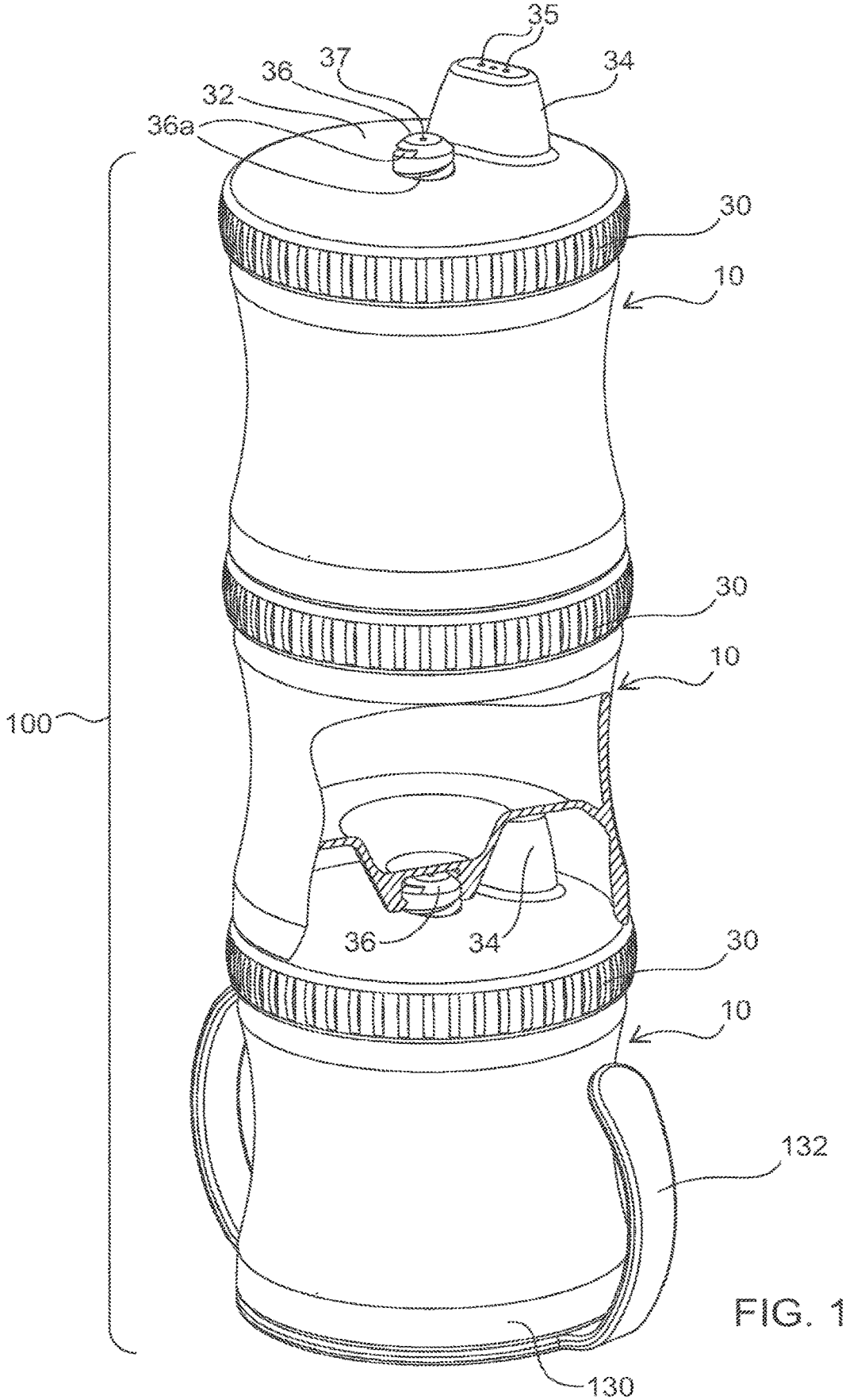
FIG. 1 is a perspective view of multiple lidded cups according to one embodiment of the invention, mated in a stack, with a portion of the interface of two cups cut away to show an example locking structure.
Figure 1A:
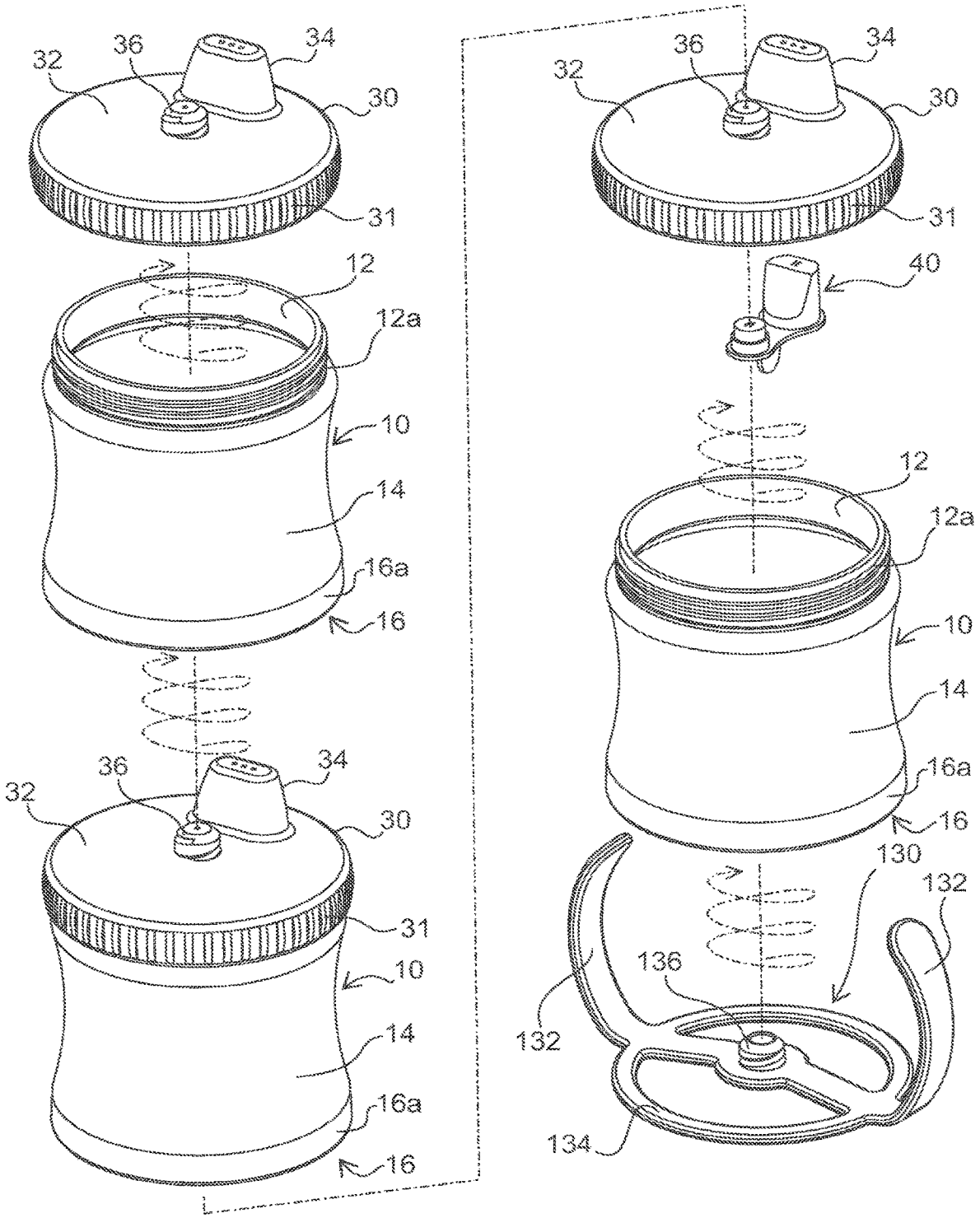
FIG. 1A is similar to FIG. 1 but shows the upper and lower cups in the stack exploded from the middle cup, and their respective lids exploded from the cups.

Referring first to FIGS. 1 and 1A, a stacking sippy cup system is shown in exemplary form in order to teach how to make and use the claimed invention. The system comprises two or more sippy cups 10, each cup having a removable lid 30 capable of mating in secure fashion not only with its underlying cup 10, but also with the bottom of another cup 10 above it to form a stack 100 of multiple lid-covered cups 10. The upper surface 32 of each lid 30 has a protruding sippy spout 34 of generally known form, radially offset from the center of the lid, with one or more fluid openings 35 of known type that limits the drinking flow of fluid from the cup. Each lid 30 also includes a locking stem 36 protruding from the radial center of the upper surface of the lid, in the illustrated example with cylindrically-mating threads 36*a* formed on the exterior of the stem, and with an optional pressure relief vent opening 37.

In the illustrated example of FIG. 1, the bottom of the bottom-most cup 10 in the stack 100 is mated to a handle attachment 130 with handles 132, rather than a lid. Handle attachment 130 attaches to the bottom of a cup 10 in the same manner as one of the lids 30, i.e., via a screw-on locking stem 136 essentially identical to stem 36 on lid 30 except for the lack of a pressure relief opening.

Cups 10 and lids 30 (and handle attachment 130) may be formed from any known plastic material suitable for use as a drinking cup, for example molded from BPA-free polyethylene or polypropylene. It would be possible to form cups 10 and lids 30 from other materials used for drinking cups, such as metal, but a modern durable lightweight plastic is preferred. The size of the cups may vary, but dimensions suitable for 8-16 oz. cups would be typical.

Each cup 10 has an open upper end or top 12, a sidewall 14, and a lower end or bottom 16. The top of cup 10 includes connecting structure such as threads 12*a* for mating in generally fluid-tight fashion with corresponding connecting structure on lid 30 in known manner, for example mating threads formed on the inside of the lid sidewall 31. The top 12 and bottom 16 of the cup and the lid 30 are preferably cylindrical as in the illustrated example, with cylindrical mating thread-forms connecting the lid to the cup, although other shapes and lid-cup connecting structures are possible.

Figure 2:
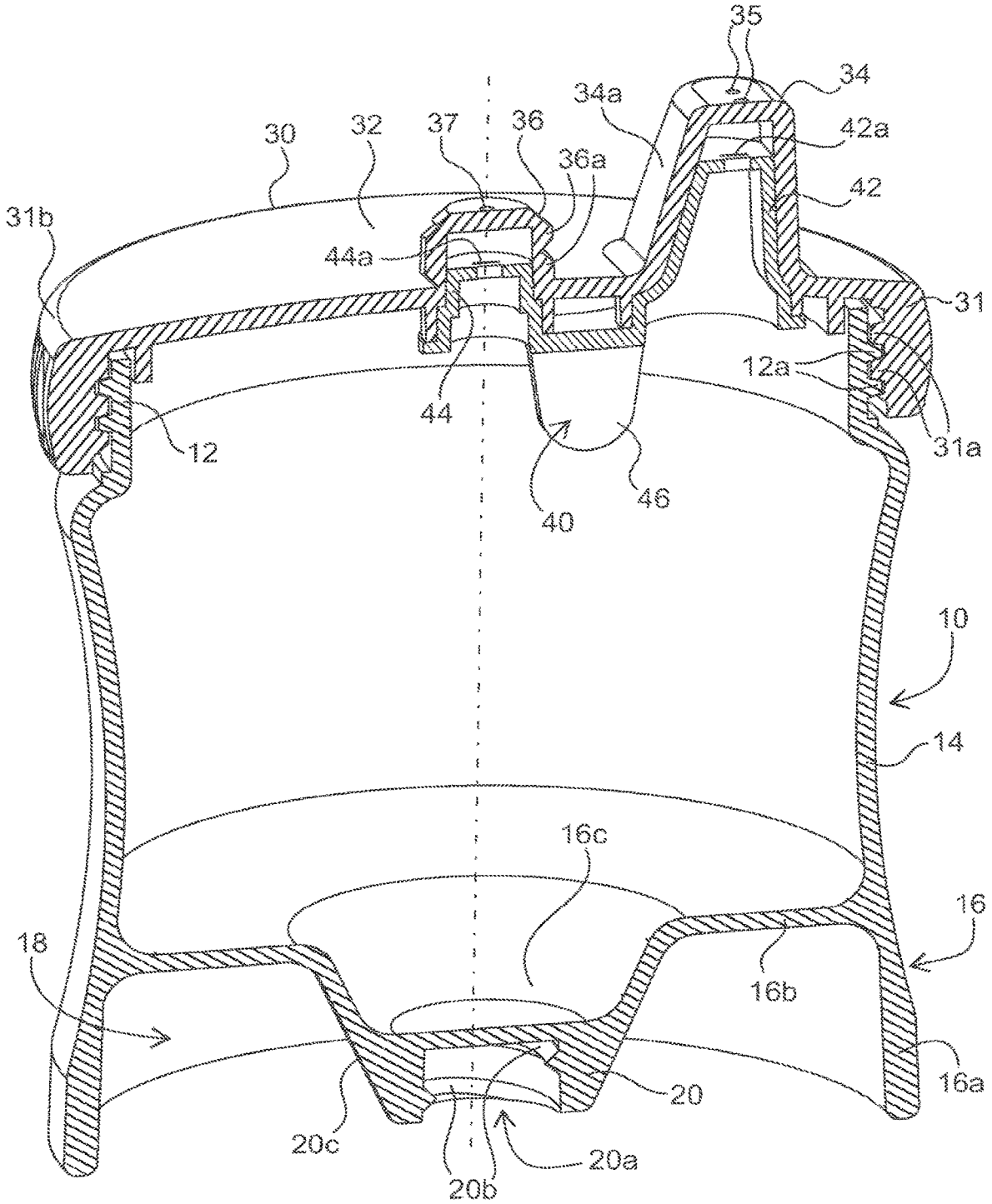
FIG. 2 is a cutaway view of one of the cups with attached lid from FIG. 1, taken from an upper (lid) perspective.
Figure 3:
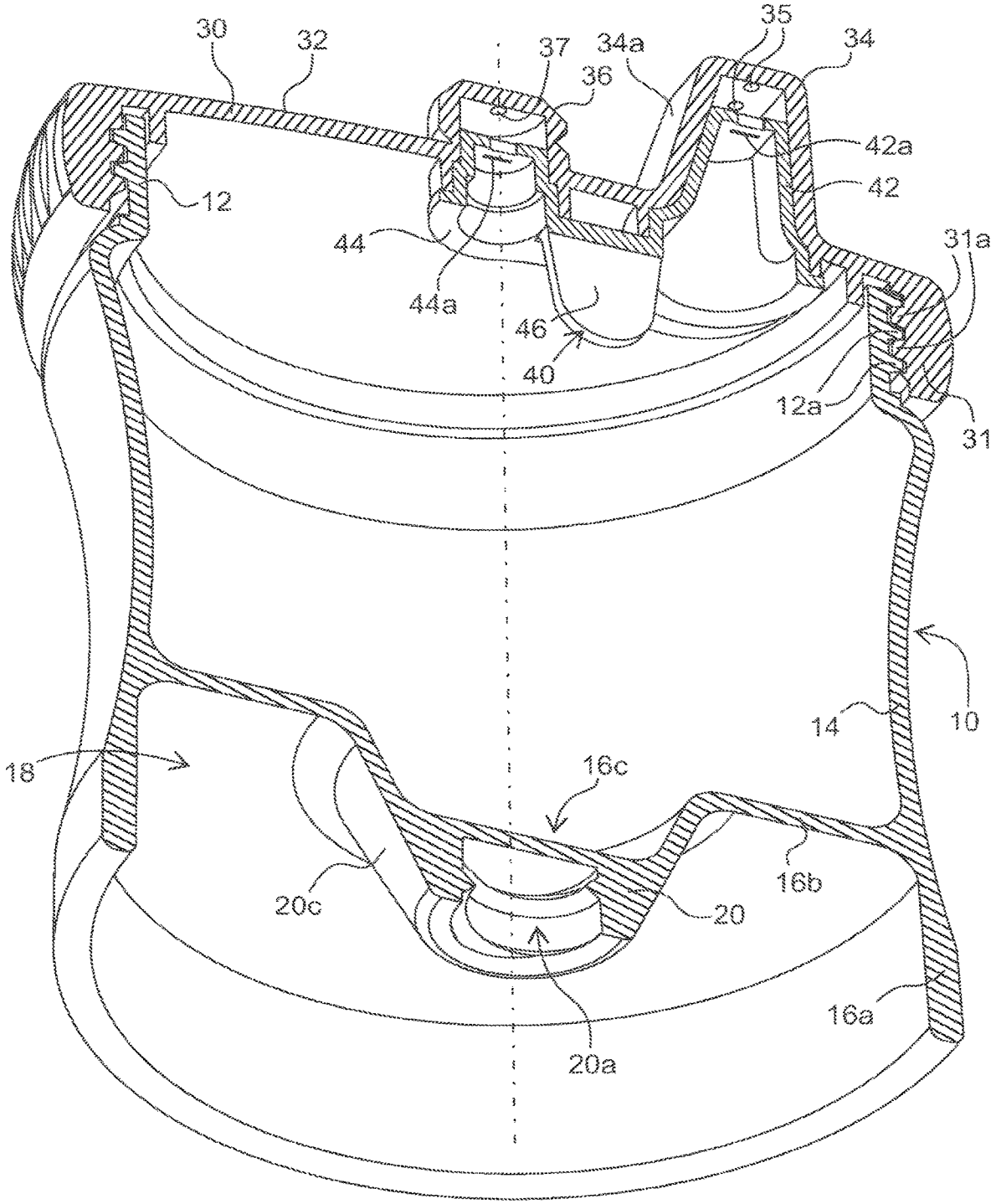
FIG. 3 is a cutaway view of one of the cups with attached lid from FIG. 1, taken from a lower (cup bottom) perspective.

Referring to FIGS. 1 through 3, the bottom 16 of cup 10 includes an outer vertical wall portion 16*a* extending downwardly beyond the interior transverse bottom surface 16*b* of the cup. The bottom outer wall 16*a* defines in part and surrounds an annular cavity 18 (FIGS. 2 and 3) formed around a radially centered locking plug 20 protruding from the bottom wall 16*b* no farther (and preferably less) than the lower edge of bottom outer wall 16*a*. The locking plug 20 in the illustrated example is "female", configured with a socket to receive a "male" locking stem 36 on a lid 30. Annular cavity 18 is deep enough to receive the sippy spout 34 on a lid 30 when the locking stem 36 on the lid is mated with the locking plug 20 on the bottom of the cup.

While the locking stem 36 is shown as a male connecting portion, and the locking plug 20 is shown as a female connecting portion, these could be reversed, with a female socket on the locking stem 36 and plug 20 configured as a male portion. While cylindrically-mating thread forms requiring multiple rotations for connection are illustrated and currently preferred, other rotating or twist connection structures such as known types of twist-lock or "bayonet" style connections that lock together with less than a full circumferential rotation are possible in place of the illustrated threads that require multiple rotations of the mating cup. Also, non-rotating or linear mechanical, magnetic, frictional, or other connections between locking plug 20 and locking stem 36 are possible, including but not limited to frictional detents or annular beads located on the respective mating stem and plug portions to "click" together with a push and securely hold the cup underneath to the cup above. And while the annular recess in the bottom of each cup is especially useful for accommodating a rotating locking connection as illustrated, with any kind of connecting structure the recess allows the lid underneath to be mated with the bottom of the cup above in any circumferential orientation and with a degree of circumferential movement that may assist with making the connection.

The diameter of lid 30 is sized to form a snug, preferably sealing fit between an outer surface portion of the lid and the bottom outer wall 16*a* of the cup above it. For example, a beveled outer edge 31*b* of the lid can mate flush with the lower edge of bottom wall 16*a* when the lid is fully mated with the bottom of the cup, i.e., when locking stem 36 is fully mated with locking plug 20, in order to fully enclose and seal the nippy spout on the lid within the bottom of the cup above it. The diameter of the plate- or ring-like flat body portion 134 of handle attachment 130 is likewise sized to fit snugly against the lower edge 16*b* of bottom wall 16*a* when the handle attachment is fully mated with the bottom of the cup.

Figure 4:
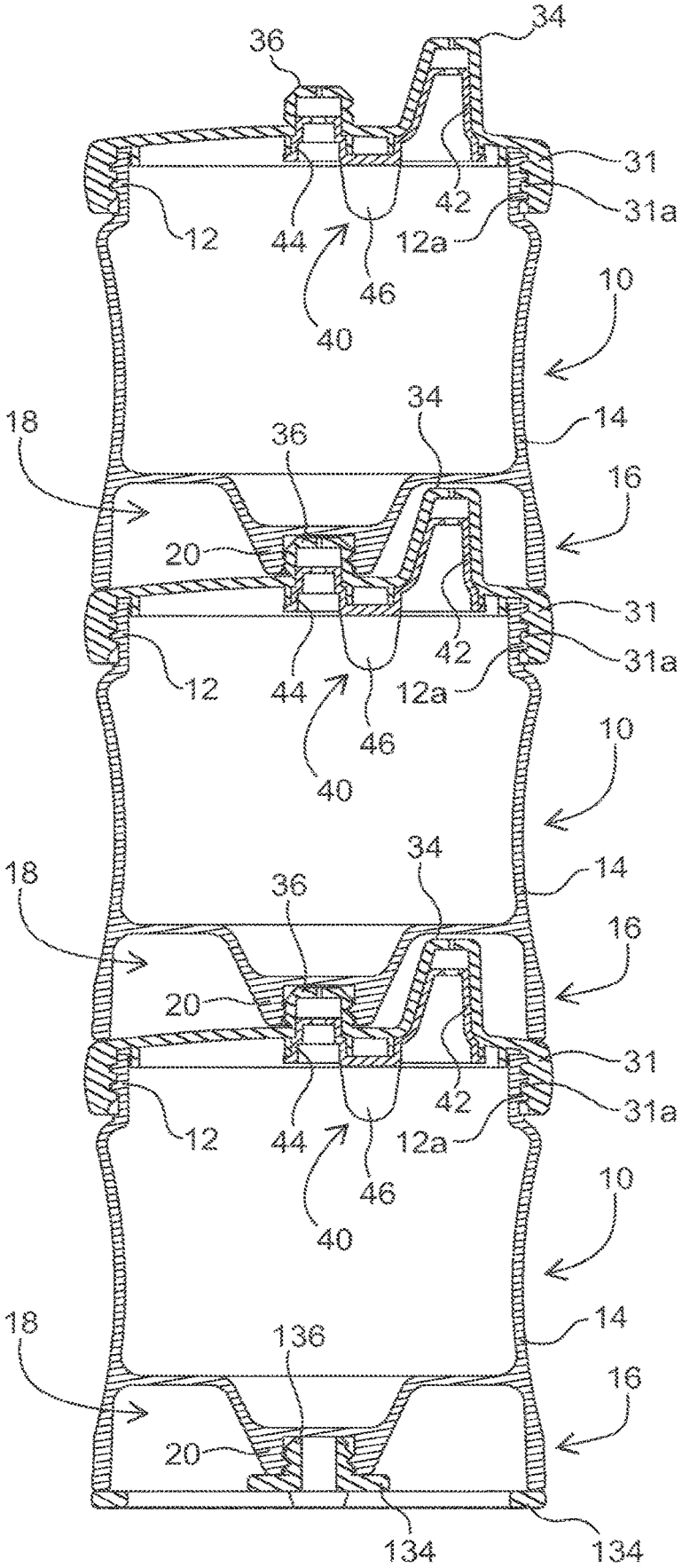
FIG. 4 is a sectional side elevation view of the stacked cups of FIG. 1.
Figure 5:
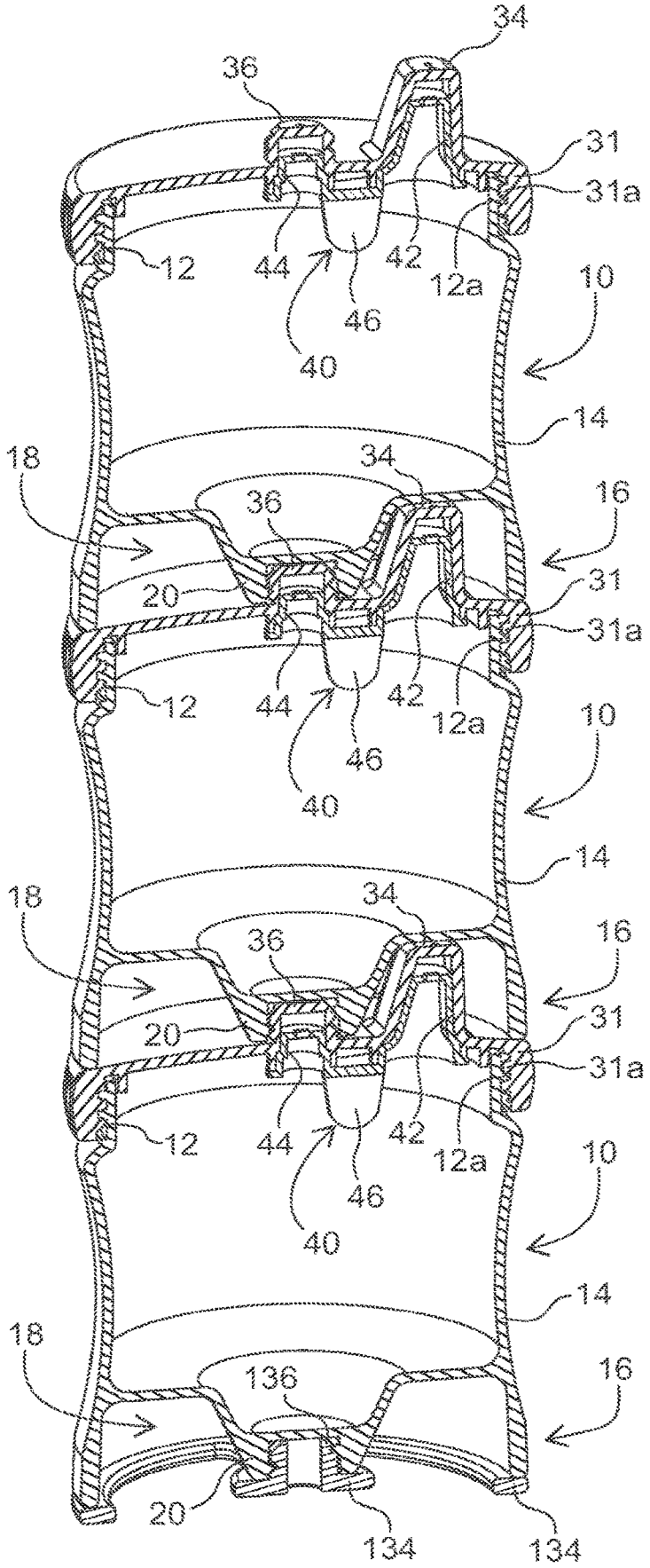
FIG. 5 is a cutaway side perspective view of the stacked cups of FIG. 1.
Figure 6:
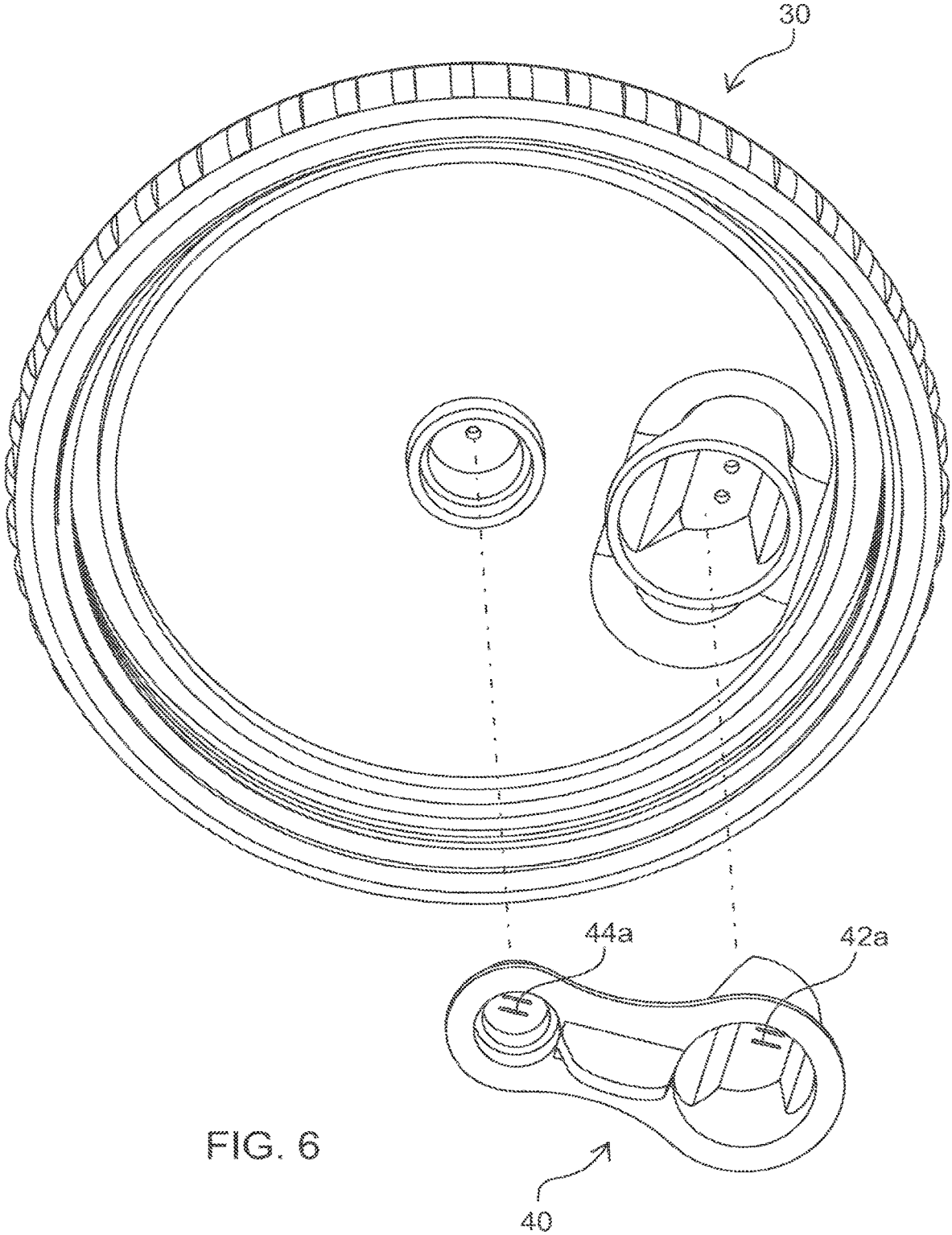
FIG. 6 is a perspective view of an underside of a lid from one of the cups in FIG. 1, with a relief valve assembly that can be mated with the central locking plug and sippy spout portions of the lid.
Figure 7:
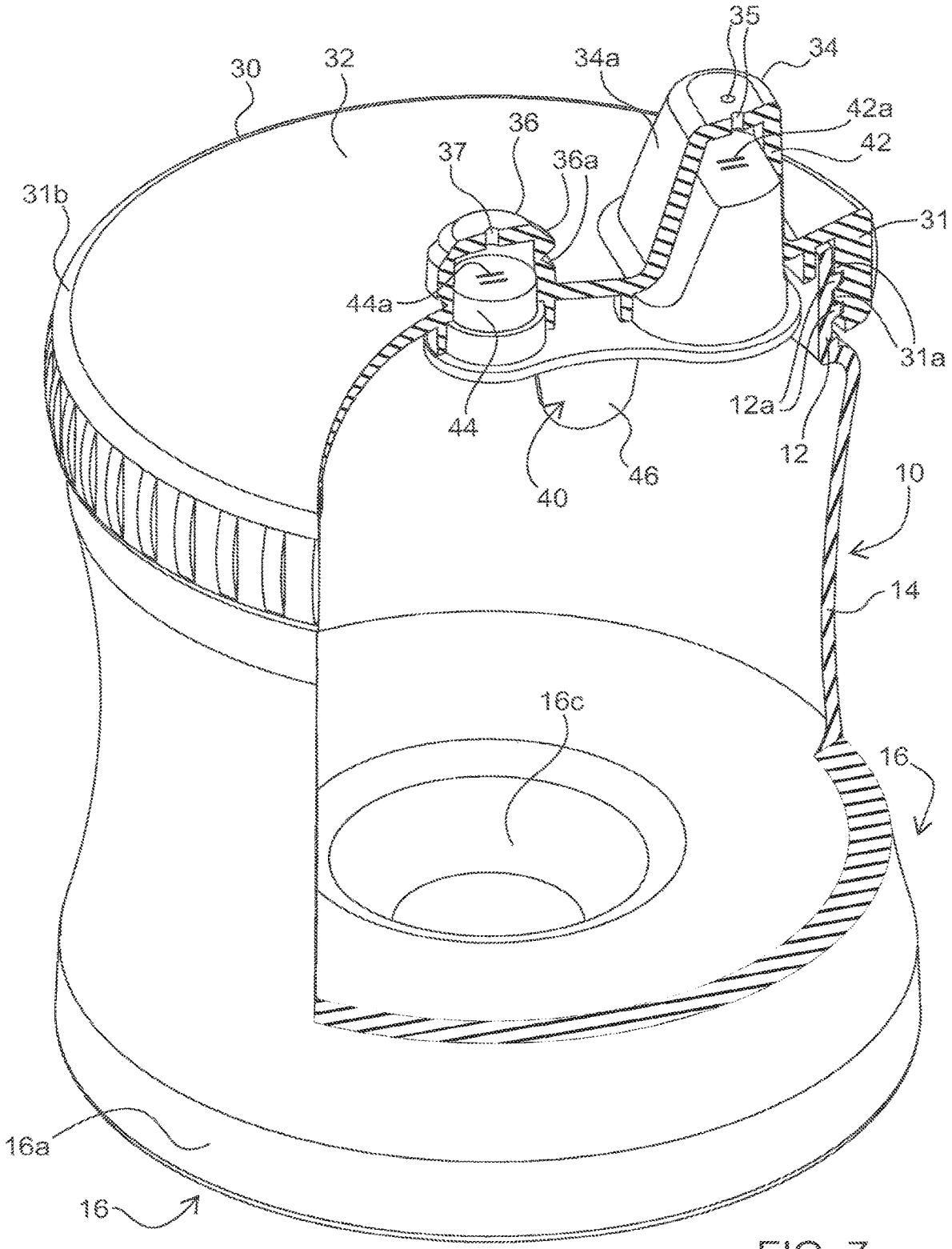
FIG. 7 is an upper perspective view of the lid of FIG. 6 and a cup, partially cutaway to show the relief valve structure inserted in the sippy spout and locking stem.

The relative heights and depths of the locking stem 36, locking plug 20, annular cavity 18, and sippy spout 34 may be sized so that some or all of them provide a positive vertical stop against each other's surfaces when the lid 30 on an underneath cup is fully mated with the bottom 16 of the cup 10 above it. This is perhaps easiest to picture in FIGS. 4 and 5.

Each cup 10 may also include a relief valve assembly 40 of known type, for example made from a soft elastomeric plastic or rubber-like material comprising one or more upstanding plug portions 42, 44 that fit snugly up into the interiors of the sippy spout 34 and the locking stem 36. Relief valve assembly 40 seals the spout and locking stem openings 35, 37 relative to any liquid in the cup, except for metered flow openings 42*a* and 44*a* that allow some fluid and air flow, respectively, to assist with drinking from spout 34. Relief valve assembly 40 may include a pull tab 46 to help remove assembly 40 from the lid 30 for cleaning.

FIGS. 2-5 show the annular nature of recess 18 in the bottom 16 of cup 10, and in particular the clearance provided in the bottom of the cup for the radially-offset sippy spout 34 of a lid 30 mated with the bottom of the cup. Sippy spout 34 may take different known configurations and may be open at the top or may be capped with a removable/openable covering or closure mechanism of known type. Whatever the size of the spout, however, annular recess 18 provides sufficient clearance both radially and vertically to receive spout 34 as locking stem 36 on lid 30 is mated with locking plug 20 on cup 10. As locking stem 36 is mated in rotating threaded fashion with locking plug 20, recess 18 allows spout 34 to rotate around the locking plug 20 within the outer bottom wall portion 16*a* of the bottom 16 of the cup.

Further as shown in FIGS. 2-5, the interior wall 34*a* of sippy spout 34 is preferably angled, narrowing upwardly toward the tip of the spout. The outer wall or surface 20*c* of locking plug 20 in the bottom of the cup may be correspondingly sized and tapered (narrowing downwardly from the base of the plug at cup bottom surface 16*b*) for better clearance between the spout and the plug.

Locking plug 20 may be formed in a way relative to cup transverse bottom surface 16*b* to create a central tapered well 16*c* in the bottom center of the interior of the cup, creating a small fluid volume extending below the generally flat transverse interior bottom wall 16*b*.

It will finally be understood that the disclosed embodiments represent presently preferred examples of how to make and use the invention but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this provisional application or in any non-provisional application claiming priority to this provisional application.

The invention claimed is:

1. A cup stacking system comprising;

two or more substantially identical cups with lids, said cups configured to be stacked with their respective lids secured on said cups, wherein: each cup comprises a sidewall, a top with a removable lid, and a bottom;

said bottom of each cup comprises an annular recess defined between a lower bottom sidewall portion and one of a locking plug and a locking stem protruding downwardly from a center portion of said bottom of said cup within a volume bounded by said lower bottom sidewall portion, said one of a locking plug and a locking stem further coaxially aligned with a longitudinal center axis of said cup;

each lid comprises the other of a locking plug and a locking stem protruding upwardly from an upper surface of said lid and coaxially aligned with a longitudinal center axis of said cup, said locking stem configured to mate in removable locking fit with said locking plug, and a sippy spout protruding upwardly from said upper surface of said lid higher than said one of said locking plug and locking stem and is radially offset outwardly from said one of said locking plug and said locking stem; and wherein, each lid while attached to the top of a second of said cups, can be lockingly mated with said bottom of a first of said cups via said locking stem removably engaging said locking plug.

2. The cup stacking system of claim 1, wherein said locking plug and said locking stem mate with a rotatable connection.

3. The cup stacking system of claim 2, wherein said locking plug and said locking stem include mating cylindrical thread form portions to mate with multiple full circumference rotations of said lid on said second cup relative to said bottom of said first cup.

4. The cup stacking system of claim 1 wherein said locking plug and said locking stem between said lid and said cup above it mate with a frictional engagement so as to "click" together with a push and securely hold said lid to said bottom of said cup above it, the frictional engagement including a frictional detent located on one of the locking plug and the locking stem and an annular bead located on the other of the locking plug and the locking stem.

5. The cup stacking system of claim 1, where said locking plug protrudes downwardly from a center portion of said bottom of said cup and said locking stem protrudes upwardly from an upper surface of said lid and coaxially aligned with a longitudinal center axis of said cup.

6. The cup stacking system of claim 5, wherein said locking plug and said locking stem mate with a rotatable connection.

7. The cup stacking system of claim 6, wherein said locking plug and said locking stem between said lid and said cup above it mate with a frictional engagement so as to "click" together with a push and securely hold said lid to said bottom of said cup above it, the frictional engagement including a frictional detent located on one of the locking plug and the locking stem and an annular bead located on the other of the locking plug and the locking stem.

8. A cup stacking system comprising:

two or more substantially identical cups with lids, said cups configured to be stacked with their respective lids secured on said cups, wherein: each cup comprises a sidewall, a top with a removable lid, and a bottom;

said bottom of each cup comprises an annular recess defined between a lower bottom sidewall portion and one of a locking plug and a locking stem protruding downwardly from a center portion of said bottom of said cup within a volume bounded by said lower bottom sidewall portion, said one of a locking plug and a locking stem further coaxially aligned with a longitudinal center axis of said cup;

each lid comprises the other of a locking plug and a locking stem protruding from an upper surface of said lid and coaxially aligned with a longitudinal center axis of said cup, said locking stem configured to mate in removable locking fit with said locking plug;

each lid while attached to the top of a second of said cups, can be lockingly mated with said bottom of a first of said cups via said locking stem removably engaging said locking plug;

each lid further comprises a sippy spout protruding from said upper surface of said lid higher than said one of said locking plug and locking stem and is radially offset outwardly from said one of said locking plug and said locking stem;

said annular recess having a sufficient volume to fully receive said sippy spout therein;

when said lid on said second cup is secured against said bottom of said first cup said sippy spout on said lid is enclosed within said annular recess on said bottom of said second cup;

each said lid also includes a relief valve assembly made from a soft elastomeric plastic or rubber-like material comprising a first upstanding sippy spout portion which fits snugly up into said sippy spout and a second upstanding portion which fits snugly into said one of said locking plug and said locking stem which protrudes upwardly from said lid;

said locking stem and said locking plug including a vent opening and said sippy spout including an opening to facilitate sucking liquid from said cup through said sippy spout on said lid;

said relief valve assembly sealing said spout opening and said one of said locking stem and locking plug opening;

said first and second upstanding portions of said relief valve assembly including valved openings which open to permit fluid or air flow when suction is applied to said sippy spout.

9. The cup stacking system of claim 8, wherein said locking plug protrudes downwardly from a center portion of said bottom of said cup and said locking stem protrudes upwardly from an upper surface of said lid and coaxially aligned with a longitudinal center axis of said cup.

10. The cup stacking system of claim 9, wherein said locking plug and said locking stem mate with a rotatable connection.

11. The cup system of claim 8 in which said relief valve assembly includes a pull tab protruding downwardly therefrom into the space below said lid, for facilitating removal of said relief valve assembly from said lid for cleaning.

12. The cup stacking system of claim 9, wherein said locking plug and said locking stem between said lid and said cup above it mate with a frictional engagement so as to "click" together with a push and securely hold said lid to said bottom of said cup above it, the frictional engagement including a frictional detent located on one of the locking plug and the locking stem and an annular bead located on the other of the locking plug and the locking stem.

13. A cup stacking system comprising: two or more substantially identical cups with lids, said cups configured to be stacked with their respective lids secured on said cups; and a removable handle attachment;

wherein: each cup comprises a sidewall, a top with a removable lid, and a bottom; said bottom of each cup comprises an annular recess defined between a lower bottom sidewall portion and one of a locking plug and a locking stem protruding downwardly from a center portion of said bottom of said cup within a volume bounded by said lower bottom sidewall portion, said one of a locking plug and a locking stem further coaxially aligned with a longitudinal center axis of said cup;

each lid comprises the other of a locking plug and a locking stem protruding from an upper surface of said lid and coaxially aligned with a longitudinal center axis of said cup, said locking stem configured to mate in removable locking fit with said locking plug; each lid while attached to the top of a second of said cups, can be lockingly mated with said bottom of a first of said cups via said locking stem removably engaging said locking plug; and the removable handle attachment comprising a generally flat disc body having a diameter equal to or greater than a cup bottom diameter, a pair of upwardly-extending handles extending from opposing sides of said disc body, and another of said locking plug and said locking stem centered on and protruding from an upper side of said body a distance less than said handles, said locking stem and said locking plug removably mating with one another to secure said disc body against said bottom of said cup and said handles are extended above said bottom of said cup spaced outwardly from said cup sidewall.

14. The cup stacking system of claim 13, wherein said locking plug and said locking stem between said handle disc body and said bottom of said cup above said handle disc body mate with a rotatable connection.

15. The cup stacking system of claim 13 wherein said locking plug and said locking stem between said handle disc body and said bottom of said cup above it mate with a frictional engagement so as to "click" together with a push and securely hold said handle to said bottom of said cup, the frictional engagement including a frictional detent located on one of the locking plug and the locking stem and an annular bead located on the other of the locking plug and the locking stem.

16. The cup stacking system of claim 13 wherein said locking plug protrudes downwardly from a center portion of said bottom of said cup and said locking stem protrudes upwardly from an upper surface of said lid and coaxially aligned with a longitudinal center axis of said cup; and wherein said one of a locking plug and a locking stem on said handle disc body is a locking stem protruding upwardly for mating engagement with said locking plug on said bottom of said cup above it.

* * * * *